United States Patent [19]

Yokota et al.

[11] Patent Number: 4,934,293

[45] Date of Patent: Jun. 19, 1990

[54] CHAINING THREAD SEW-IN DEVICE

[75] Inventors: Rokuro Yokota, Sakai; Takeshi Orita, Itami; Yukio Nishiura, Kawanishi, all of Japan

[73] Assignee: Pegasus Sewing Machine Mfg., Co., Ltd., Osaka, Japan

[21] Appl. No.: 286,220

[22] Filed: Dec. 19, 1988

[30] Foreign Application Priority Data

Dec. 28, 1987 [JP] Japan ..... 62-335235
Dec. 28, 1987 [JP] Japan ..... 62-335236

[51] Int. Cl.[5] ..... D05B 65/06

[52] U.S. Cl. ..... 112/288; 112/DIG. 1; 112/287

[58] Field of Search ..... 112/239, 286, 287, 288, 112/DIG. 1

[56] References Cited

U.S. PATENT DOCUMENTS

| | | | |
|---|---|---|---|
| 2,988,031 | 6/1961 | Reid | 112/253 |
| 3,356,054 | 12/1967 | Southwell et al. | 112/252 |
| 3,490,403 | 1/1970 | Boucrant | 112/252 |
| 3,698,336 | 10/1972 | Launer | 112/252 |
| 3,922,983 | 12/1975 | Schips et al. | 112/288 |
| 4,038,933 | 8/1977 | Marfario | 112/288 |
| 4,149,478 | 4/1979 | Sanvito et al. | 112/286 |
| 4,187,793 | 2/1980 | Fietta et al. | 112/288 |
| 4,220,105 | 10/1980 | Palacino | 112/287 |
| 4,679,515 | 7/1987 | Keeton | 112/262.1 |
| 4,763,590 | 8/1988 | Kojima et al. | 112/288 X |
| 4,774,900 | 10/1988 | Aida et al. | 112/288 X |

FOREIGN PATENT DOCUMENTS

| | | |
|---|---|---|
| 48-48850 | 6/1973 | Japan . |
| 54-40195 | 11/1979 | Japan . |
| 55-36359 | 9/1980 | Japan . |

*Primary Examiner*—Andrew M. Falik
*Attorney, Agent, or Firm*—Jones, Tullar & Cooper

[57] ABSTRACT

A chaining thread sew-in device of an overlock sewing machine is related having a first pinching plate and a second pinching plate which form a part of the working face of the sewing machine on the operator side of a needle drop point. The plates are capable of opening an insertion hole into which a free end side of a chaining thread linked to the sewing machine side can be inserted in the working face by driving the first pinching plate, capable of pinching the chaining thread between itself and the second pinching plate, toward the second pinching plate. By returning the first pinching plate to the initial position while the chaining thread is inserted into the insertion hole a cutter 30 capable of crossing the chaining thread cuts the chaining thread by moving the second pinching plate 71 to the first pinching plate 71 side in when the chaining thread is inserted into the insertion hole.

18 Claims, 12 Drawing Sheets

CHAINING THREAD SEW-IN DEVICE

BACKGROUND OF THE INVENTION

1. Field of the Invention

This invention relates to a chaining thread sew-in device installed in an overlock sewing machine, which is used to cut the chaining thread formed consecutively with the seams formed on a cloth when an edge of the cloth is overedged by the overlock sewing machine, by leaving a specified length from the sewing machine side, and to sew the chaining thread consecutive into the seams on the next cloth from the sewing machine side.

2. Description of the Prior Art

A conventional chaining thread sew-in device mounted on an overlock sewing machine was effected by: installing a chaining thread holder/cutter composed of a cutter and a pinching member made of an elastic material on the working face on the operator side of the needle drop point of the sewing machine cutting a chaining thread brought to the operator side of the sewing machine by the operator together with the cloth when sewing is finished and pressed against the cutter, by pinching a free end of the cut chaining thread by the pinching member so as to hold the chaining thread left on the sewing machine side on a throat plate of the machine and by preventing loosening of seams at the starting point of sewing without conducting specific bar tacking by sewing the chaining thread into the seams of the next cloth.

In such a chaining thread sew-in device, however, the operator moved the cloth to the operator side of the needle drop point every time the sewing of a cloth was finished in order to cut the chaining thread formed consecutively to the cloth, and therefore the working efficiency could not be improved or the operation could not be automated.

To solve the above problems, proposed in U.S. Pat. No. 4,149,478 was a chaining thread sew-in device. To suck a chaining thread linked to the seams formed on a cloth into a suction tube on the back side of a needle drop point; to cut the chaining thread by a cutter installed in an opening of the suction tube for leaving a specified length from the sewing machine side; to move a free end of the chaining thread linked to the sewing machine side to the operator side of the needle drop point by air pressure; to suck the free end of the chaining thread moved in this way into a chaining thread free end suction part; and to pinch the free end of the chaining thread by actuating a chaining thread pinching part installed in the working face of the cloth plate.

The conventional apparatus represented by the one disclosed in the above U.S. Pat. No. 4,149,478 was designed to dispose the chaining thread pinching part and the free end suction part of the chaining thread on the working face of the machine, and as a result, the chaining thread pinching part disturbs the cloth feeding thereby reducing the working efficiency of the machine.

Besides, in the apparatus with a strong pinching force of the chaining thread in the chaining thread pinching part, when sewing the chaining thread, the free end of which is pinched into the seams on the next cloth, the edge of the cloth is pulled by the chaining thread and curled downward.

Another problem in the conventional device was that, as the length of chaining thread sewn into the seams of the cloth was determined by the cutting position of the cutter installed in the opening of the suction tube, it was difficult to change the length of the chaining thread to be sewn in dependence on the product.

Other known technologies about the present invention aside from the one in U.S. Pat. No. 4,149,479, are disclosed in U.S. Pat. Nos. 4,187,793, 4,220,150, 4,644,884 and 4,679,515.

SUMMARY OF THE INVENTION

In order to solve the problems, it is a primary object of this invention to present a chaining thread sew-in device of an overlock sewing machine which does not prevent the insertion of the cloth or cloth feeding, which does prevent the edge of the cloth from being curled by the sewing of the chaining thread, and is capable of the changing the length of chaining thread to be sewn into the seams of the cloth.

It is another object of this invention to present a chaining thread sew-in device of an overlock sewing machine designed so as not to blow air against the operator in the working process and yet is capable of leading the free end of the chaining thread securely to the insertion hole.

It is still another object of this invention to present a chaining thread sew-in device of an overlock sewing machine in which two pinching plates installed so as to achieve the above primary object can be moved smoothly.

It is a related object of this invention to present a chaining thread sew-in device of an overlock sewing machine which is designed so that the chaining thread should be set at a specified position without overlapping the needle drop point when the free end of the chaining thread moved to the operator side of the needle drop point is pinched by the two pinching plates.

It is a further related object of this invention to present a chaining thread sew-in device of an overlock sewing machine in which the free end of the chaining thread moved to the operator side of the needle drop point can be securely inserted into the insertion hole.

To achieve the above and other objects, this invention presents a chaining thread sew-in device of an overlock sewing machine designed to suck a chaining thread formed consecutively to the seams produced at an edge of a cloth by an overlock sewing machine into a suction hole of a suction device installed on the rear side of the needle drop point and to cut the chaining thread in the suction hole, to move the free end of the chaining thread left on the sewing machine side to the operator side of the needle drop point by air pressure, and to sew the chaining thread moved in this way into the seams formed on the next cloth. The chaining thread sew-in-device comprises:

a first pinching plate forming a part of the working face of the sewing machine on the operator side of the needle drop point and capable of being moved so as to open an insertion hole in which the free end of the chaining thread moved from the suction hole can be inserted on the working face;

chaining thread insertion means for inserting the free end of the chaining thread into the insertion hole by the air;

a second pinching plate which touches the first pinching plate when the insertion hole is not opened, or forms a part of the opening edge of the insertion hole when the insertion hole is opened, and besides which can move in the direction approaching the first pinching plate side in the state that the insertion hole is opened and can move the free end side of the chaining thread toward the first pinching plate side, accompanying its movement toward the first pinching plate side; and a cutter allocated so as to cross its fixed knife with its movable knife in the moving region of the chaining thread caused by the movement of the second pinching plate to the first pinching plate side.

DETAILED DESCRIPTION OF THE INVENTION

Figure 1:
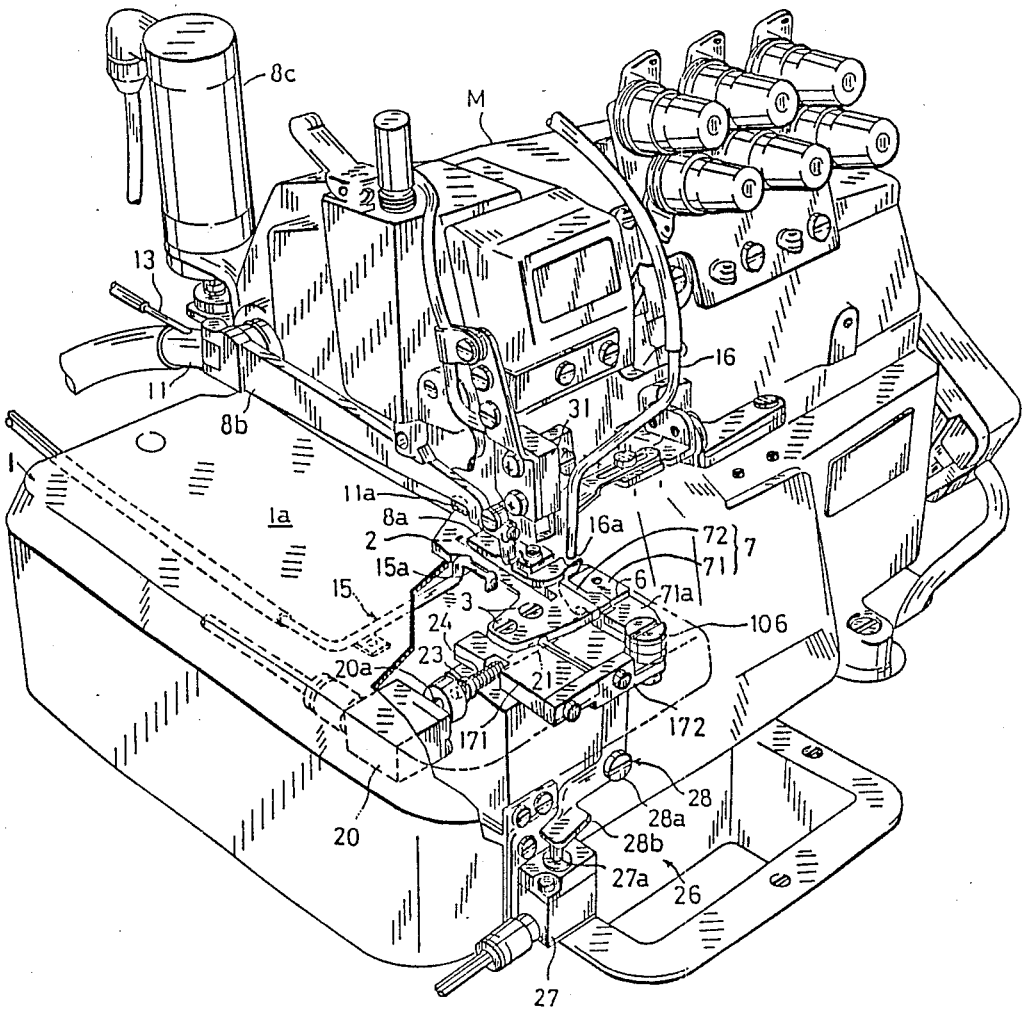
FIG. 1 is a partially cut-away perspective drawing showing the chaining thread sew-in device of an overlock sewing machine according to the present invention.

In a chaining thread sew-in device of an overlock sewing machine constructed according to the present invention, it is possible to insert the free end of the chaining thread, moved to the operator side of the needle drop point, into the insertion hole opened by the driving the first pinching plate, and to pinch the chaining thread between the first pinching plate and the second pinching plate by closing the insertion hole as a result of returning the first pinching plate to the initial position. At this moment, the first and second pinching plates will not disturb the cloth inserted from the operator side of the sewing machine onto the throat plate, and the cloth can be fed straight, thus the working efficiency is not reduced.

When the next cloth is inserted after the chaining thread is pinched, it is intended to release the pinching of the chaining thread by driving the first pinching plate to open the insertion hole when several stitches are formed after the top end of the cloth passes the needle drop point, and thereby the top end of the cloth is prevented from curling by being stretched by the chaining thread. As a result, the quality of the product is improved.

The chaining thread pushed away to the second pinching plate crosses with the cutter by driving the second pinching plate in a direction approaching the first pinching plate when a specified period of time passes after releasing the pinching of the chaining thread, so that the chaining thread to be sewn into the seams formed on the cloth is cut while leaving a specified length. That is, the length of the chaining thread sewn into the seams on the next cloth can be preset appropriately, so that a step to cut the chaining thread projected from the seams after the product is finished can be omitted, and thereby the working efficiency can be enhanced and the quality of product improved.

In the chaining thread sew-in-device of an overlock sewing machine according to the present invention, moreover, a blow pipe is connected to the suction device and an air blow-out port is provided on the cloth plate obliquely ahead of the suction hole and obliquely behind the insertion hole, so that the free end of the chaining thread may be moved from the suction hole to the operator side of the needle drop point in the steps of blowing out of free end of chaining thread from the suction hole by air supplied through the blow pipe and moving the free end of the chaining thread to the insertion hole side by the air blow-out port.

In a so designed chaining thread sew-in device of an overlock sewing machine, the chaining thread cut in the suction hole by the suction device and left on the sewing machine side is discharged from the suction hole by the air blown out from the blow pipe, and only a small quantity of air may be required for the ejection and the ejection time may be also very short. Accordingly, the air blown out from the blow pipe connected to the section device barely hits the operator. In addition, the chaining thread ejected from the suction hole is moved to the chaining thread pinching part side by the air blown out from the air blow-out port located on the cloth plate and running in a direction where no operator sits, and the operator is thus not exposed to the air. The operator's health therefore will not be affected by being attacked repeatedly by cold air.

In the chaining thread sew-in device of an overlock sewing machine according to the present invention, the first pinching plate and the second pinching plate move linearly in a direction to cross the sewing axis of the sewing machine. This configuration enables the plates to be moved smoothly.

Moreover, in another chaining thread sew-in device of an overlock sewing machine according to the present invention, the first pinching plate and the second pinching plate rotate about their rotation axis.

When constructed in this way, it is possible to strictly determine the pinching of the chaining thread by both plates, and it is thus possible to cross the chaining thread pinched at that pinching point with the cutter always at a certain position in the movement accompanying the rotation of the second pinching plate.

Besides, the chaining thread sew-in device of an overlock sewing machine according to the present invention is designed so that the seams formed on an edge of the cloth by an overlock sewing machine should be formed by twining a thread on a tongue integrally formed on the throat plate and opposing the side face of the throat plate across a slit extending rearward from the needle drop point. The tongue is recessed as a stepped part for engaging the base end of the chaining thread at the rear end part and on an opposing side to the side face of the throat plate.

If designed in the above way, when the chaining thread cut apart from the seams formed on the preceding cloth is moved from the suction hole to the operator side of the needle drop point by air pressure, the base end of the chaining thread linked to the sewing machine side is engaged with the stepped part for engaging the base end of the chaining thread formed on the tongue. The chaining thread ahead of the base end mounts the tongue, but will not overlap the needle drop point to be fixed. The needle, hence, will not cross the chaining thread to cause the chaining thread to project from the front end of the cloth when sewing the chaining thread fixed on the throat plate into the next cloth, so that better quality of products can be presented.

In the chaining thread sew-in device of an overlock sewing machine of the present invention, the thread insertion means may be designed either to insert the free end of the chaining thread into the insertion hole by blowing air into the insertion hole side from the upper part of the working face of the sewing machine, or to insert the free end of the chaining thread into the insertion hole by sucking the air from the lower part of the working face of the sewing machine.

Figure 2:
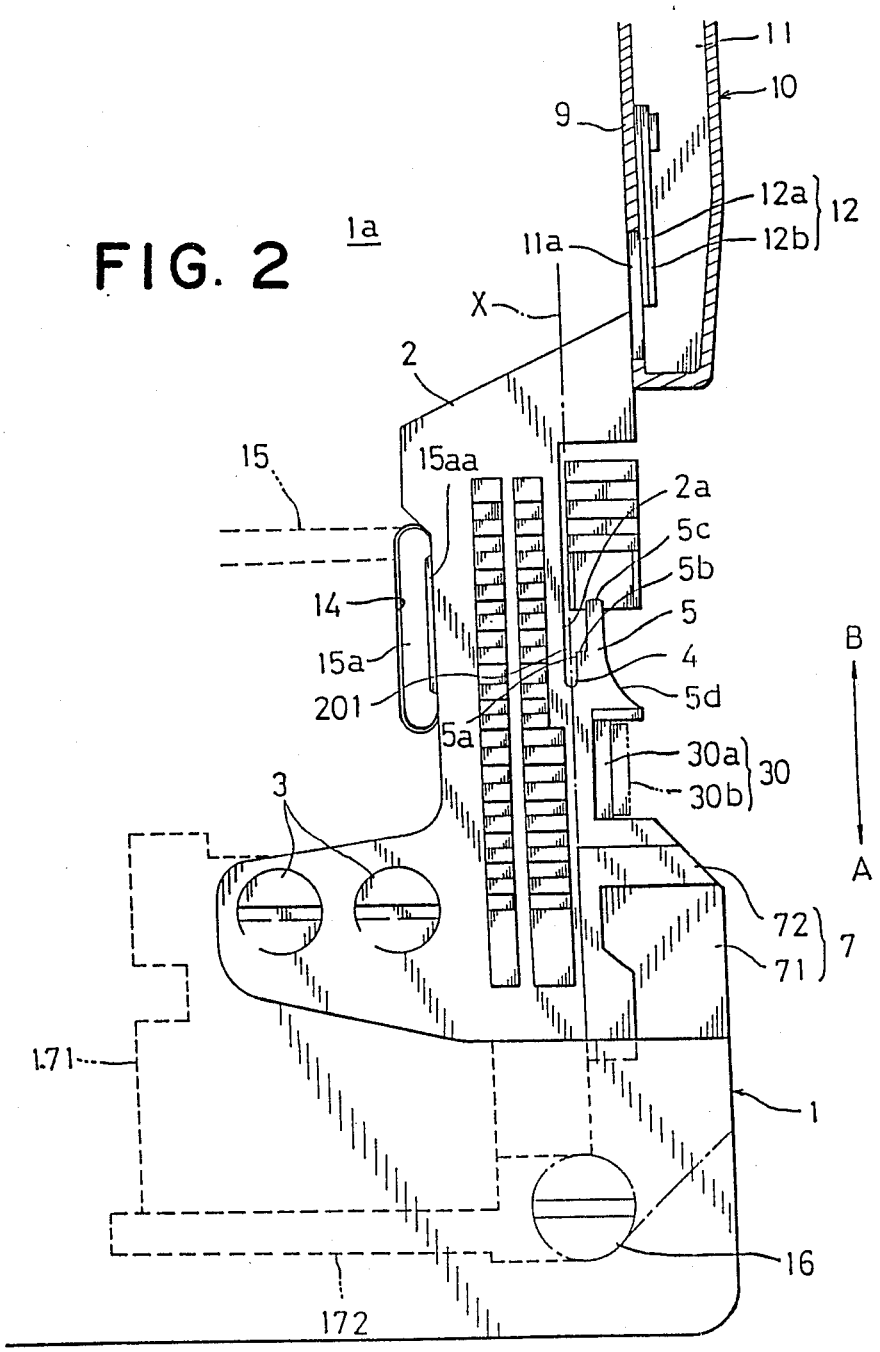
FIG. 2 is a plan view of its working face.

In the perspective view of FIG. 1 and the plan view of FIG. 2, numeral 1 refers to a cloth plate of an overlock sewing machine, and in a working face 1*a* of the cloth plate 1, a throat plate 2 is interposed at the position corresponding to a needle. The throat plate 2 is fixed on a bracket 171 mounted on the main body M of the sewing machine with bolts 3, and its upper face composes a part of the working face 1*a*. In the throat plate 2, a needle drop point 4 penetrating the working face 1*a* in the vertical direction is formed, on which a tongue 5 extending backward (in direction of arrow B in FIG. 2) starting from a neighboring part of the needle location 4 is integrally attached. The tongue 5 extends parallel to a side face 2*a* of the throat plate 2 forming a slit 201 starting from the needle drop point 4 and extending backward. A stepped part 5*b* for engaging the chaining thread base end is formed on the rear end side of the opposing side 5*a* to the side face 2*a* by notching the rear end part at right angles. Another lateral side 5*d* of the tongue 5 consecutive with the opposing side 5*a* through the apex 5*c* on the rear end is curved parabolically in a direction to widen the width of the tongue 5 in the direction indicated by arrow A in FIG. 2. Here, X indicated by a dot-dash line in FIG. 2 is a sewing axis of this overlock sewing machine corresponding to a cloth-feeding direction passing the needle drop point 4, and the side face 2*a* of the throat plate 2 is parallel to this sewing axis X.

In the working face 1*a* on the side of the tongue 5 and the operator side (in the direction of arrow A in FIG. 2) of the needle point 4 with regard to the sewing axis X, a recess 6*a* of which one side parallel to the sewing axis X is opened, is formed, and a pinching plate assembly 7 the upper face of which is in the same plane as the working face 1*a* and which forms a part of the working face 1*a* is inserted in the recess 6.

The pinching plate assembly 7 comprises a second pinching plate 72 formed in and L-shaped seen from the front along the bottom side and a side on the forward side on the recess 6, and a first pinching plate 71 matching with the L-shaped corner of the second pinching plate 72, the first pinching plate 71 and the second pinching plate 72 always touching each other on the side parallel to the sewing axis X.

Figure 3:
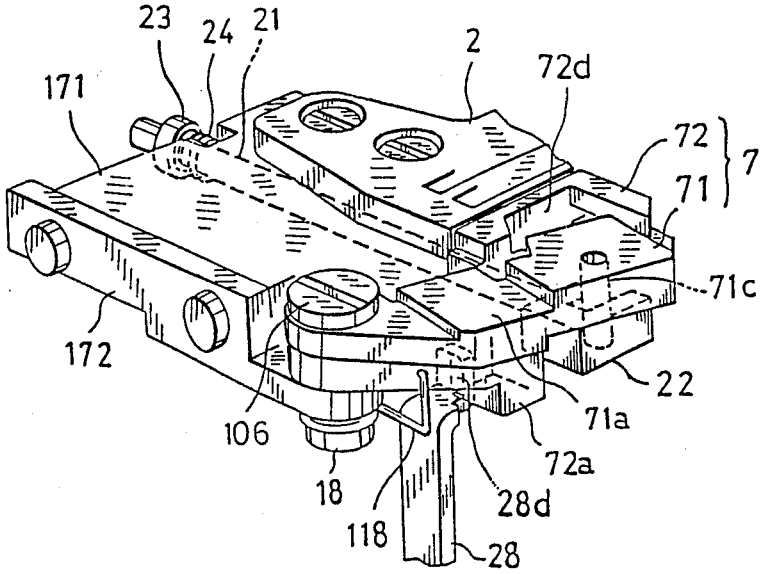
FIG. 3 is a magnified perspective view of the chaining thread pinching part.
Figure 4:
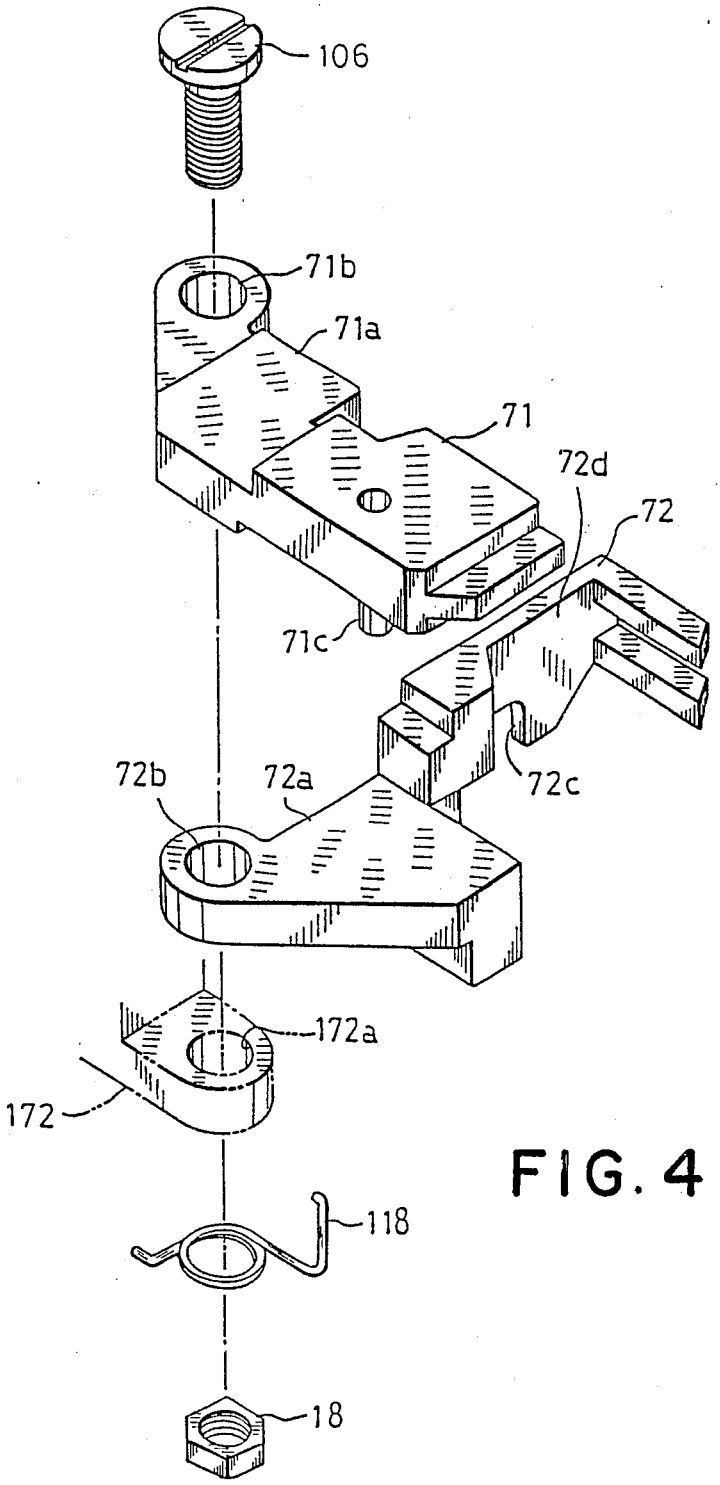
FIG. 4 is an exploded perspective view of the chaining thread pinching part.

As shown in FIGS. 3 and 4, an arm 71*a* passing beneath the cloth plate 1 and extending to the operator side of the sewing machine is integrally formed on the first pinching plate 71, and on the tip of this arm 71*a*, a bolt penetrating hole 71*b* is formed. On the other hand, an arm 72*a* passing further beneath the arm 71*a* integrally formed on the first pinching plate 71, extending to the operator side of the sewing machine, and sliding to contact with the arm 71*a* is formed integrally on the second pinching plate 72, and a bolt penetrating hole 72*b* is formed at the tip of the arm 72*a*. To the already described bracket 171 attached to the main body M of the sewing machine, an auxiliary bracket 172 at which end a bolt penetrating hole 172*a* is opened as shown in FIG. 4 is fixed by a bolt.

The arms 71*a*, 72*a* of the first pinching plate 71 and second pinching plate 72 are rotatably attached to the auxiliary bracket 172 by a bolt 106 penetrating their respective bolt penetrating holes 71*b*, 72*b* and the bolt penetration hole 172*a* of the auxiliary bracket 172, and thereby the first pinching plate 71 and the second pinching plate 72 are rotated on the working face 1*a*. Numeral 18 is a nut screwed on the bolt 106, which connects the first and second pinching plates 71 and 72 and the auxiliary bracket 172. Numeral 118 is a torsion spring coiling around the bolt 106, and an end of the torsion spring 118 abuts against the arm 72*a* which is integral with the second pinching plate 72 and thrusts the second pinching plate 72 to the side touching the throat plate 2.

The first pinching plate 71 is driven by actuating a first air cylinder 20 located beneath the cloth plate 1.

That is, a columnar stud 71*c* for operation is projected beneath the first pinching plate 71, and with this stud 71*c* for operation, an engaging member 22 mounted on an end of a rod 21 penetrating the bracket 171 and the second pinching plate 72 in the direction orthogonal to the sewing axis X and supported slidably on the bracket 171 is engaged. Meanwhile, numeral 72*c* shown in FIG. 4 is a recess penetrated by the rod 21 formed on the second pinching plate 72. The engaging member 22 is bisfurcated opening forward, and the stud 71*c* for operation is pinched slidably between the two legs of the bifurcated engaging member 22. Into the projecting part from the bracket 171 of the rod 21 are screwed male threads, to which a spring stopper 23 is screwed. A compression spring 24 is interposed between the spring stopper 23 and the bracket 171, and the first pinching plate 71 engaged with the rod 21 by the thrusting force of this compression spring 24 is thrust in the direction (indicated by an arrow C in FIG. 6A) to touch the second pinching plate 72. To a piston rod 20*a* of the first air cylinder 20, a rod pushing member 25 is attached, which abuts against or approaches the tip of the rod 21 in the state that the first pinching plate 71 touches the second pinching plate 72 when the piston rod 20*a* withdraws. The first air cylinder 20 is installed at the position where the rod pushing member 25 pushes the rod 21 resisting the thrusting force of the compression spring 24 by extending the piston rod 20*a*.

Figure 6A:
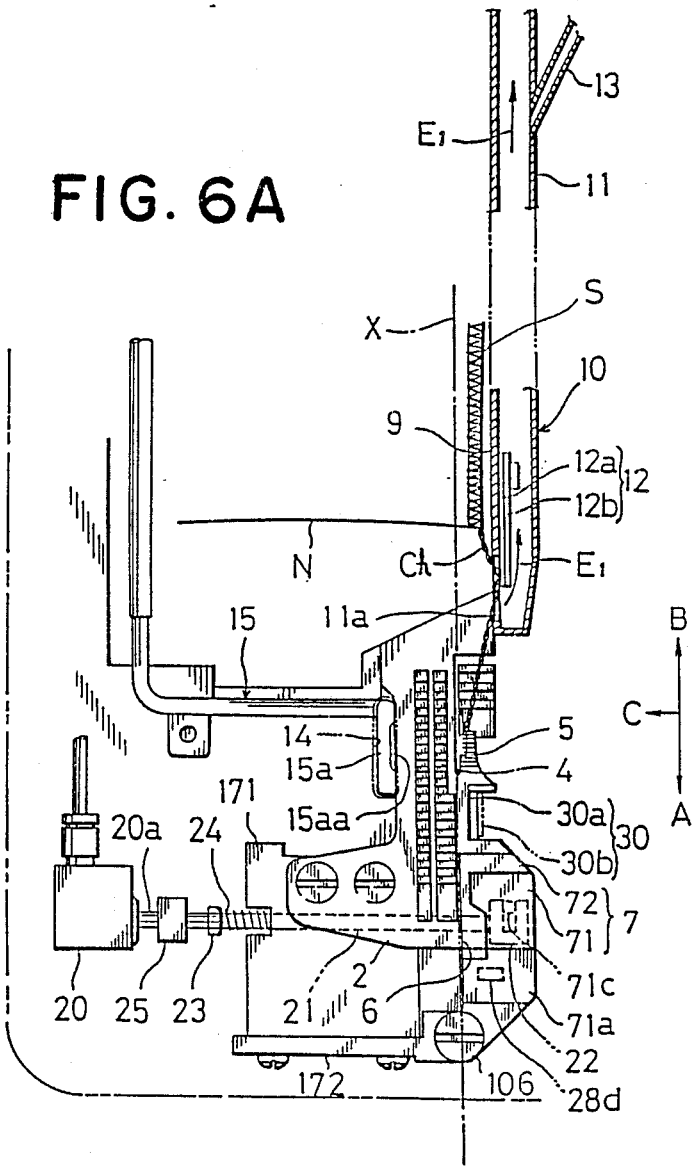
FIGS. 6A to 6F are schematic plan views showing the process of handling the chaining thread.
Figure 6B:
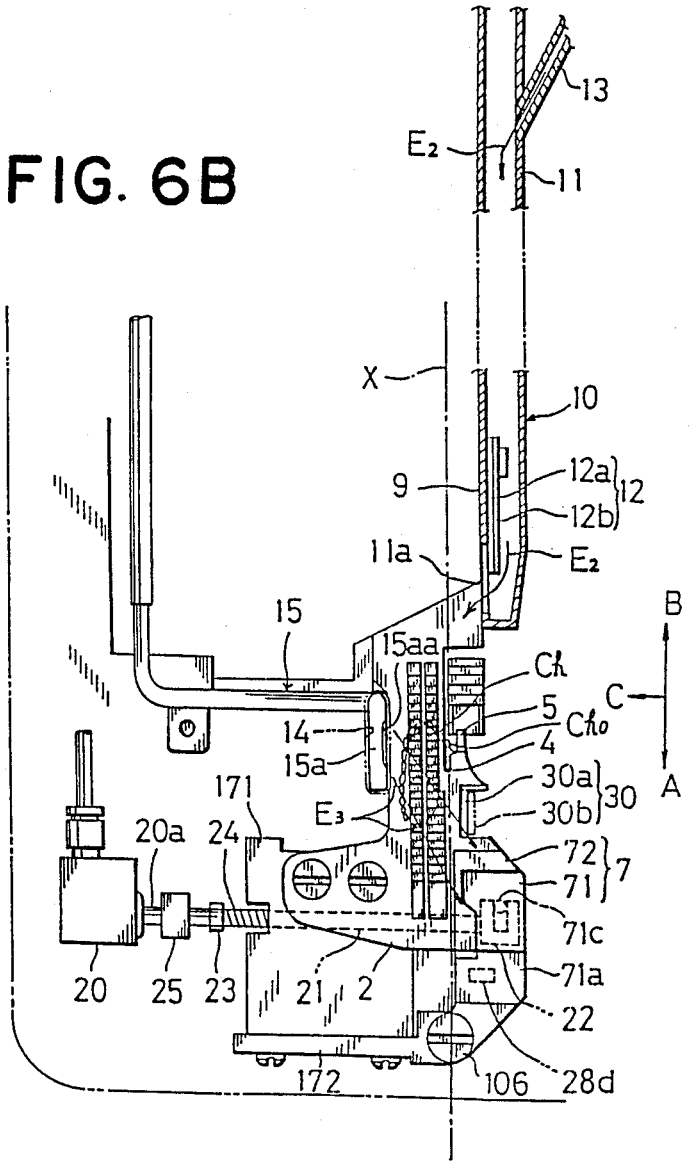
Figure 6C:
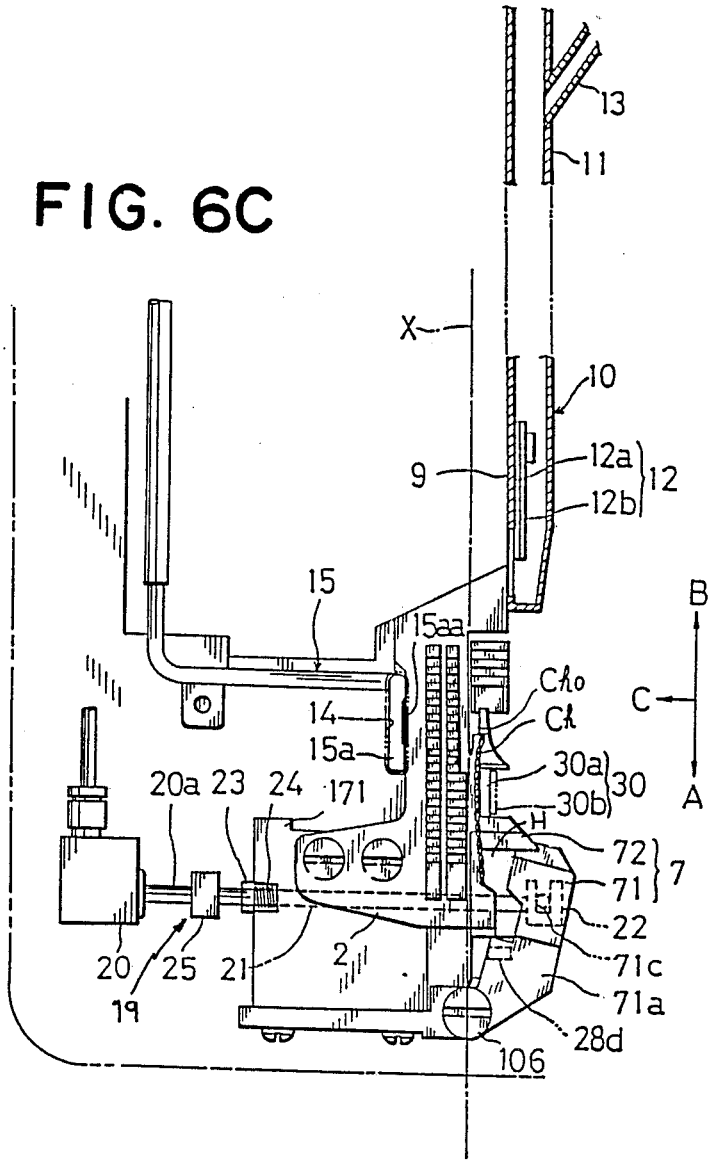

Accordingly, when the piston rod 20*a* of the first air cylinder 20 is extended, the first pinching plate 71 can be rotated around the bolt 106 be displaced from the L-shaped corner of the second pinching plate 72, thereby forming an insertion hole H comprising the second pinching plate 72 as a part of the edge of the opening on the cloth plate 1*a* as shown in FIG. 6C.

As a consequence, the first air cylinder 20, rod 21, engaging member 22, spring stopper 23, compression spring 24 and rod pushing member 25 compose a first driving mechanism 19 for driving the first pinching plate 71.

Sequentially, the second pinching plate 72 is driven by a second air cylinder 27 installed at the lower part in the cloth plate 1 as its driving source.

To describe the mechanism in detail, a tip of a rocker arm 28 for transmitting the action of the second air cylinder 27 abuts against the arm 72*a* integrally formed on the second pinching plate 72. This rocker arm 28 is formed in L-shape and the corner 28*a* is pivoted rotatably; upper end 28*d* of a side standing from the corner abuts against the arm 72*a* as described above and shown in FIG. 3. Furthermore, at the tip of a side extending laterally from the corner 28*a* of the rocker arm 28 is formed a rod stopper 28*b* abutting against a piston rod 27*a* advancing or withdrawing in the vertical direction of the second air cylinder 27. Consequently, when the piston rod 27*a* of the second air cylinder 27 extends to push up the rod stopper 28*b*, the rocker arm 28 oscillates around the corner 28*a* and its tip 28*d* abutting against the arm 72*a* pushes up the arm 72 resisting the thrust force of the torsion spring 118. When the arm 72*a* is pressed in this way, the second pinching plate 72 formed integrally on the arm 72*a* is rotated around the bolt 106 in a direction away from the recess 6. At the moment, if the piston rod 27*a* of second air cylinder 27 is withdrawn, the tip 28*d* of the rocker arm 28 returns to the initial position, and the arm 72*a* is hence thrust by the torsion spring 118 to rotate to the position where the second pinching plate 72 abuts against the throat plate 2 on the sewing axis X.

As described above, the second air cylinder 27 and the rocker arm 28, comprise a driving mechanism 26 for driving the second pinching plate 72.

Numeral 8*a* is a presser foot to pinch the cloth, which is a work piece, with the throat plate 2, and this presser foot 8*a* is mounted at the tip of a presser rest 8*b* pivoted oscillatably on the rear side of the main body M of the sewing machine, and the presser rest 8*b* is oscillated by actuating the air cylinder 8*c* so as to vertically move the presser foot 8*a* between the cloth pressing position and the releasing position.

Besides, a cloth guide 9 parallel to the sewing axis X at a specified distance from the sewing axis X is provided and is raised from the working face 1*a* behind the tongue 5 as shown in FIG. 2.

A chaining thread cutting unit 10 is attached to the back side of the guide face of this cloth guide 9. This chaining thread cutting unit 10 has a suction passage the inner wall of which partially forms the back face of the cloth guide 9, and a suction hole 11*a* of the suction passage 11 extends through the cloth guide 9 near the rear end of the throat plate 2. A first cutter 12 is installed near the opening of the suction hole 11*a*.

The suction passage 11 is connected to an air suction source (not shown) and it is designed to suck the chaining thread formed consecutively with the cloth through the suction hole 11*a* by operating this air suction source. The suction passage 11 is an air passage parallel to the sewing axis X of the sewing machine, and this air passage has, at its terminal end, a suction hole 11*a* facing a direction which crosses with the sewing axis X. The suction passage 11 has moreover, half-way of the passage, a small diameter blow pipe 13 for pressure-feeding air to the side of suction hole 11*a*.

The first cutter 12 comprises a fixed knife 12*a* an edge of which is fixed at the bottom end on the rear side of the suction hole 11*a*, and a movable knife 12*b* pivoted rotatably on the outside of the suction passage 11 and inserted into the suction passage 11 from the upper face of the suction passage 11. The movable knife 12*b* is designed so that its edge crosses with the edge of the fixed knife 12*a* by being driven by a member linked to the spindle of the sewing machine. As a result, when the terminal end of the cloth, on which a chaining thread is formed consecutively to the seams, is moved to the back side so as to cross the chaining thread with the cutter 12, the chaining thread is cut while leaving a specified length on the sewing machine side. Here, the drive of the movable knife 12*b* may not always be linked to the drive of the sewing machine, and it is possible, for example, to count the number of stitches after the terminal end of the cloth passes the needle drop point 4 and to drive by a solenoid or the like after arresting a sewing machine when the specified number of stitches has been counted, or it is possible to drive movable knife 12*b* by pedal operation when the operator confirms that the chaining thread is formed to be a specified length.

Figure 5:
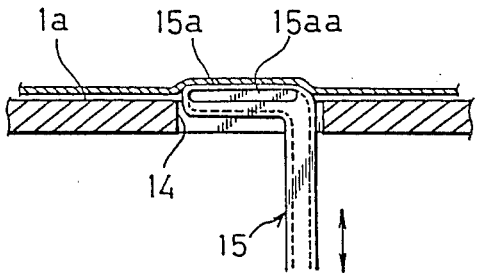
FIG. 5 is a magnified sectional view of essential parts of a blow pipe.

A slot 14 parallel to the sewing axis X is opens, as shown in FIG. 5, into the working face 1*a* which is obliquely ahead of the suction hole 11*a*, and obliquely behind the pinching plate assembly 7, and also on the opposite side of the tongue 5 with regard to the sewing axis X. From the slot 14 a nozzle 15*a* of a blow pipe 15 connected to an air supply source (not shown) is projected. This nozzle 15*a* is formed by bending, at right angles, the angles, the tip of the blow pipe, the edge of which is closed, and installing an air blow-out port 15*aa* which is elongated transversely in the axial direction of the pipe and opening toward the side of the tongue 5 in the peripheral wall of this bent tip. The air blown out from the air blow-out port 15*aa* formed in this way is blown out from an end of the nozzle 15*a* along the working face 1*a* toward the other end, and as a result, it is sent as shown by arrow E3 in FIG. 6B obliquely ahead, that is, toward the side of piniching plate 7.

Numeral 16 ia a blow pipe equipped with, at its tip, a nozzle 16*a* which is an air blow-out port. The blow pipe 16 is supported on the main body M of the sewing machine so as to blow air against the side of insertion hole H formed as the first pinching plate 71 is driven.

Between the tongue 5 and the pinching plate assembly 7 is disposed a second cutter 30 composing a fixed knife 30*a* and a movable knife 30*b* having edges respectively parallel to the sewing axis X. The second cutter 30 is located in the region between an area in which the touching face 72*d* of the second pinching plate 72 to the first pinching plate 71 ordinarily moves when the second pinching plate 72 is driven by the second driving mechanism 26, and a linking part of the chaining thread to the sewing machine side. The movable knife 30*b*, meanwhile, crosses with the fixed knife 30*a* by oscillating synchronously with the drive of the sewing machine.

Numeral 31 (FIG. 1) is a cloth detecting sensor for detecting the presence or absence of the cloth.

The operative procedure of the above chaining thread sew-in device is described below.

At first, the overlock sewing machine forms the seams S at the edge of the cloth N, and makes a chaining thread Ch linked to the terminal end of the cloth N by twining the thread on the tongue 5 as shown in FIG. 6A. This chaining thread Ch is cut apart from the cloth N by leaving almost a specified length on the sewing machine side when the operator moves the terminal end of the cloth N so as to cross with the first cutter 12 as shown in FIG. 6A. When the sewing machine is driven, the air supply source connected to the suction passage 11 is in the active state and the air is sucked into the suction passage 11 as shown by arrow E1 in FIG. 6A. The chaining thread linked to the seams on the cloth N is consecutively sucked into the suction hole 11*a* automatically. As a result, when the terminal end of the cloth N is moved to an edge of the suction hole 11*a* so as to cross the chaining thread Ch with the first cutter 12, the chaining thread Ch is cut apart from the cloth N while leaving roughly a specified length on the sewing machine side as shown in FIG. 6A. When cut apart in this way, the free end of the chaining thread Ch left on the sewing machine side is sucked into the suction passage 11 passing the front side of the suction hole 11*a* where the fixed knife 12*a* and the movable knife 12*b* of the first cutter 12 do not cross each other, and by the suction force, the chaining thread Ch is stretched and a large part which is coiled around the tongue 5, is pulled out from the tongue 5 by leaving its base end part $Ch_0$. Then, the base end part $Ch_0$ is left in the state in which it is coiled backward from the stepped part **5*b* of the tongue 5**.

In such a state the free end side of the chaining thread Ch cut in this way is sucked into the suction passage 11, the drive of the sewing machine is arrested and the presser foot **8*a*** is lifted by stepping on the foot pedal (not shown) of the sewing machine.

Sequentially, the operation of the air suction source connected to the suction passage 11 is arrested and the air is pressure-fed from the blow pipe 13. The air pressure-fed from the blow pipe 13 is sent to the side of the suction hole **11*a* as shown by arrow E2 in FIG. 6B but the air ejected from the suction hole 11*a* opened toward the side of the suction passage 11 advances obliquely ahead because the suction passage 11 is parallel to the sewing axis X. Accordingly, the chaining thread left on the sewing machine side and sucked into the suction hole 11*a* is pushed out of the front of the air blow-out port 15*aa* existing obliquely ahead of the suction hole 11*a* as shown in FIG. 6B. Here, the air pressure-fed from the blow pipe 13 is only for pushing the free end side of the chaining thread Ch staying in the suction hole 11*a* out of the suction hole 11*a*. It is therefore not a large volume of air, and the blowing time period is momentary. There is, hence, almost no effect of the air pressure-fed from the blow pipe 13** on the operator.

When the chaining thread Ch is pushed out from the suction passage 11 and the pressure air flow from the blow pipe 13 is stopped, the air is sequentially blown out from the nozzle **15*a* of the blow pipe 15 and simultaneously the piston rod 20*a* is extended by actuating the first air cylinder 20. Moreover, the air is blown out also from the nozzle 16*a* of the blow pipe 16**.

Since the air blown out from the nozzle **15*a* of the blow pipe 15 pushes the existing air toward the pinching plate 7 side along the working face 1*a* as described above, the free end of the chaining thread Ch pushed out to the front of the nozzle 15*a* by the blow pipe 13 is in turn moved to the pinching plate assembly 7 side by the air blown out from the nozzle 15*a*. The air sent out from the nozzle 15*a* of the blow pipe 15 is blown from the opposite side of the tongue 5** with respect to the sewing axis X toward the obliquely ahead side (from the left of the sewing axis X to the near right side in the drawing), and hence it does not hit the operator usually working with his body positioned on the left side of the sewing axis X.

At the same time, the first pinching plate 71 is meanwhile rotated about the bolt 106 along with the extension of the piston rod **20*a*, so as to open the insertion hole H on the operator side of the needle drop point. Then the free end of the chaining thread Ch is blown in to the insertion hole H as shown in FIG. 6C by the air blown downward from the nozzle 61*a* (FIG. 1). At this moment, the base end part $Ch_0$ of the chaining thread Ch coils around behind the stepped part 5*b* recessed on the opposite side 5*a* of the tongue 5 which is parallel to the sewing axis X as described above, and therefore the chaining thread Ch engages the stepped part 5*b* during the movement and the base end part $Ch_0$ does not move to the position of the needle drop point 4 rather it is pulled to the operator side of the needle drop point 4**.

Figure 6D:
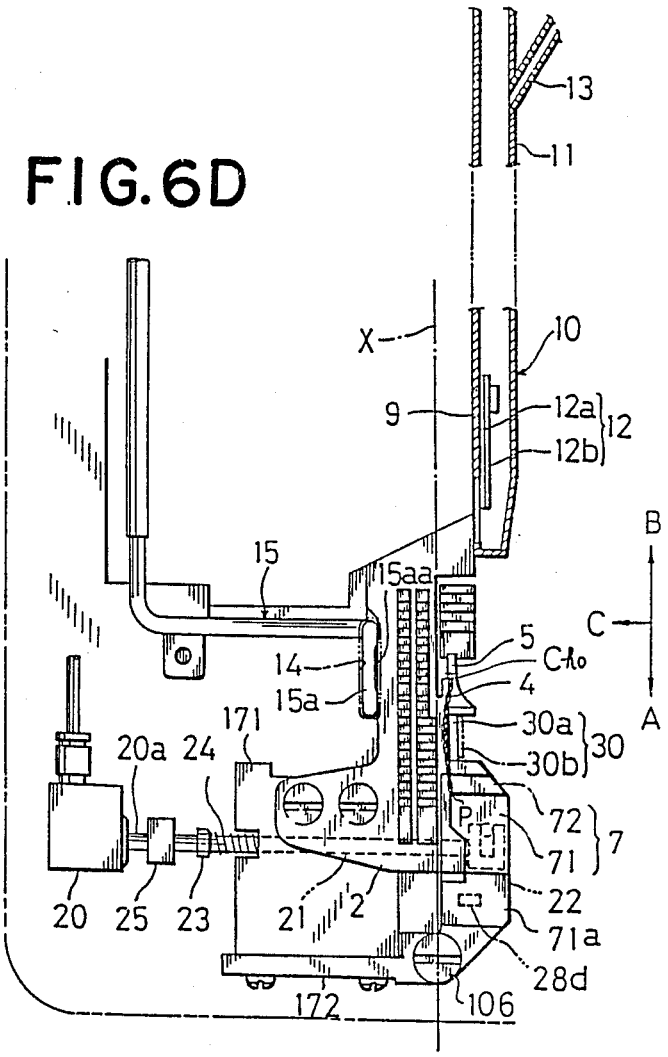

When the chaining thread Ch is blown into the insertion hole H in this way, the drive of the first pinching plate 71 is arrested to withdraw the piston rod **20*a* so as to close the insertion hole H, and the chaining thread Ch is thereby pinched between the first pinching plate 71 and the second pinching plate 72. At this time, the second pinching plate 72 is formed in an L-shaped along the bottom side and a side on the front side of the recess 6 formed on the working face 1*a* so that the first pinching plate 71 may fit in the L-shaped corner, and the pinching point P (see FIG. 6D) of the chaining thread Ch by the first pinching plate 71 and the second pinching plate 72 is thus determined accurately and the line connecting the pinching point P and the chaining thread Ch forming part is always allocated at a stable position. Accordingly, the chaining thread Ch pinched at the pinching point P crosses the cutter 30 always at a specified position by rotating the second pinching plate 72, and it is cut without causing insufficient cutting. Meanwhile, the chaining thread Ch is pinched without looseness as shown in FIG. 6D by setting the blowing time of air from the nozzle 16*a* longer than the driving time of the first air cylinder 20 so as to blow the air from the nozzle 16 in the period from starting withdrawal of the piston rod 20*a* until the insertion hole H is closed. The chaining thread Ch is fixed on the working face 1*a* so as to be sewn into the next cloth in the above manner, but the base end part $Ch_0$ is engaged with the stepped part 5*b* to the tongue 5 as described above so as not to move to the position of the needle drop point 4, and therefore the chaining thread Ch will never be overlapped and fixed on the needle drop point 4**.

Here, it is possible to dispose a suction pipe having an opening below the insertion hole H to be used together with the blow pipe 16 in order to pinch the chaining thread Ch securely in the state without any looseness.

When the chaining thread Ch is pinched as shown in FIG. 6D in the above way, the presser foot **8*a* is brought down to the clutch pressing position on the throat plate 2**.

Sequentially, after inserting the cloth (not shown) in the specified position by operating the pedal for lifting the pressure foot of the sewing machine to raise the pressure foot **8*a* to the release position, the cloth is pinched between the presser foot 8*a* and the throat plate 2 by letting down the presser foot 8*a* and the sewing machine is driven in this state to form seams at the terminal end of the cloth. In this step, since the chaining thread Ch is fixed at a specified position without overlapping the needle drop point 4, it is sewn between the seams and the cloth without crossing with the needle of the sewing machine. Incidentally, as the upper faces of the first pinching plate 71 and the second pinching plate 72** compose a part of the working face, these pinching plates will not disturb the cloth to be inserted from the operator side of the sewing machine onto the throat plate.

The up and down motion of the presser foot **8*a* can be effected by detecting the presence of absence of the cloth by the cloth sensor 31, and controlling the air cylinder 8*c*** by its signal.

Figure 6E:
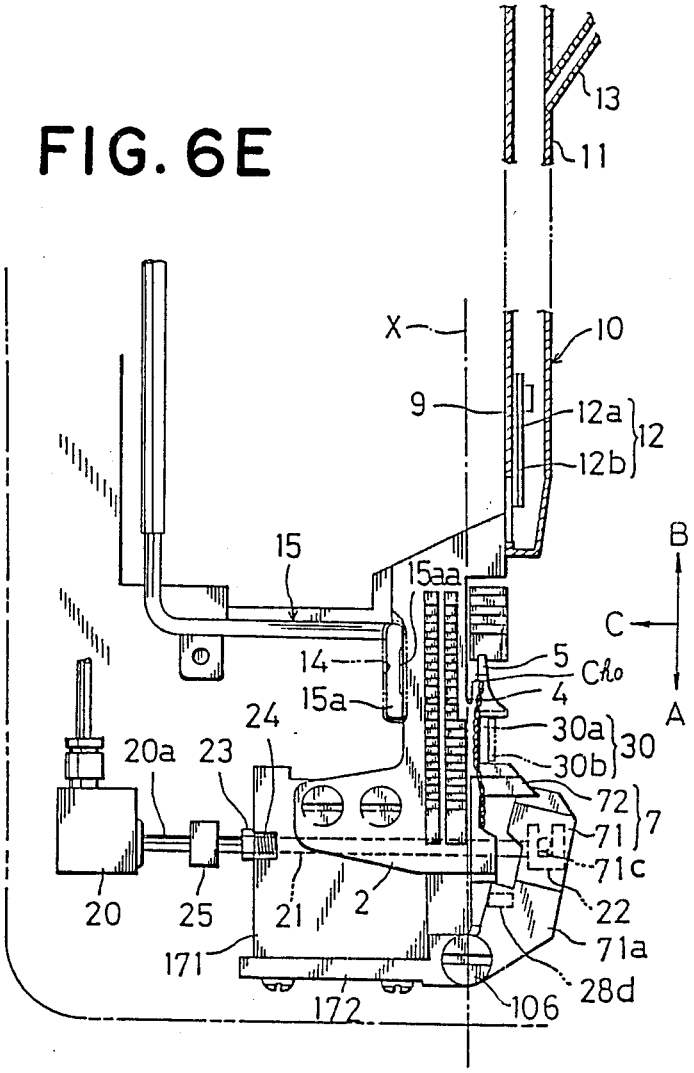

At this moment, in order to start forming the seams at the edge of the cloth, when advancing several stitches after the top end of the cloth reaches the needle drop point 4, the first air cylinder 20 is actuated again to extend the piston rod **20*a*. In other words, when the seams are formed at the top end of the cloth, and the free end of the chaining thread Ch is started to be sewn into the seams, the first pinching plate 71 is moved to the insertion hole opening side to release the pinched chaining thread Ch as shown in FIG. 6E. When the pinched chaining thread Ch is released in this way, the chaining thread Ch is sewn into the seams without stretching the top end of the cloth and thereby the end of the cloth is prevented from being curled. The number of stitches after the cloth end reaches the needle drop point 4** until the pinching of the chanining thread Ch is released should be determined appropriately depending on the material of the cloth, for example, relatively many stitches may be sewn in a hard cloth, but only one or two stitches can be allowed in a soft cloth such as lace.

When a specified period of time passes after driving the sewing machine for forming the seams, the second air cylinder 27 is driven while keeping the first pinching plate 71 at the opening position of the insertion hole H, so as to extend the piston rod 27*a* of the second air cylinder 27. This piston rod 27*a* pushes up the rod stopper 28*b* of the rocker arm 28 and by being pushed up, the rocker arm 28 oscillates around its corner 28*a*. By this oscillation, the upper tip 28*d* of the rocker arm 28 pushes the arm 72*a* integrally formed on the second pinching plate 72 resisting the thrust force of the torsion spring 118 thrusting the second pinching plate 72 to the side touching the throat plate 2. As a result, the second pinching plate 72 rotates about the bolt 106 to the side approaching the first pinching plate 71 located at the opening position of the insertion hole, and at the same time the chaining thread Ch is pushed to the first pinching plate 71 side by the touching face 72*d* with the first pinching plate 71. In this case, the chaining thread Ch will never move to the position of the needle drop point 4 because its base end part $Ch_0$ is engaged with the stepped part 5*b* of the tongue 5.

Figure 6F:
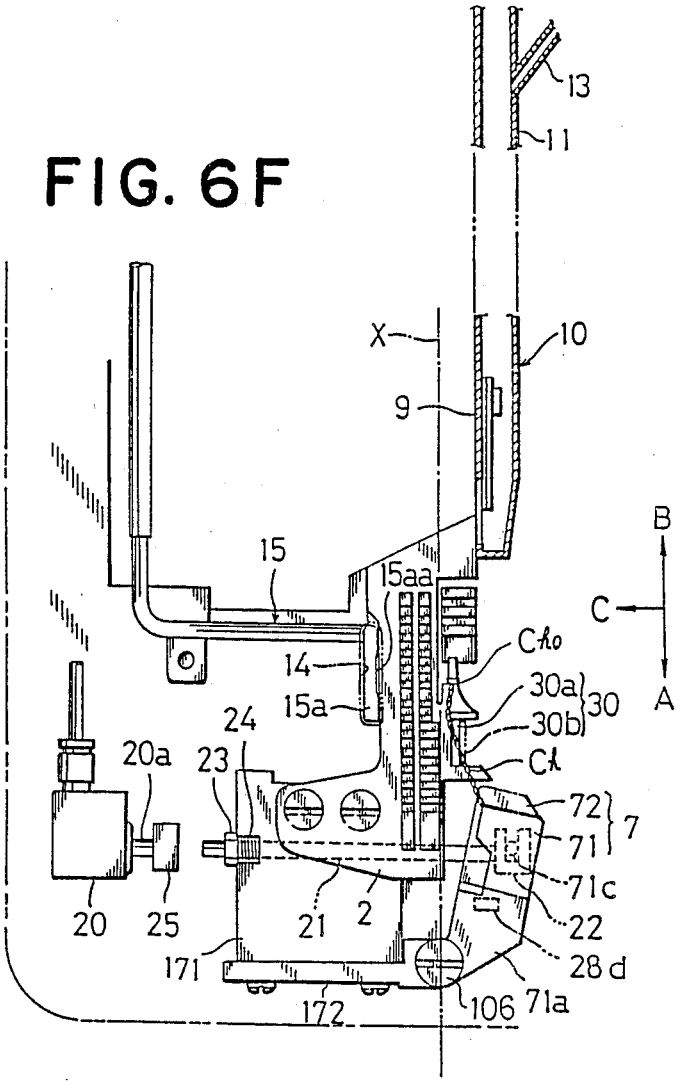

The chaining thread Ch crosses the second cutter 30 and is inserted between the fixed knife 30*a* and the movable knife 30*b*, before the second pinching plate 72 which pushes away the chaining thread in this way touches the first pinching plate 71 at the insertion hole opening position as shown in FIG. 6F, or as this second pinching plate 72 further rotates after contacting the first pinching plate 71 while pushing it. Then, as the movable knife 30*b* is driven synchronously with the drive of the sewing machine, the chaining thread Ch is cut while leaving the part to be sewn into the seams on the cloth.

As is apparent from the above explanation, the length of the chaining thread sewn into the seams on the cloth varies depending on the timing for driving the second pinching plate 72. In other words, the length of the chaining thread to be sewn into the cloth can be selected by changing the specified period of time from the start of forming the seams at the edge of the cloth to the start of actuating the second air cylinder 27.

Figure 7:
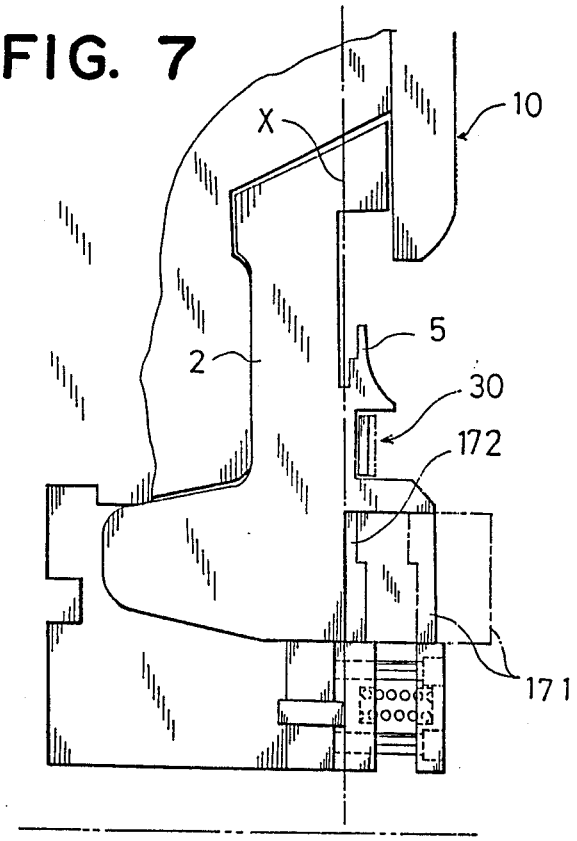
FIG. 7 is a plan view of a modified example of the first and second pinching plates.

In the embodiment shown in the drawing, the first pinching plate 71 and the second pinching plate 72 are designed to rotate about the bolt 106 as their rotation axis, but by using the pinching plates designed to move linearly in the direction crossing the sewing axis X of the overlock sewing machine as the first pinching plate 171 and the second pinching plate 172 shown in FIG. 7, it is possible to drive in the completely same procedure as those in the case using the first pinching plate 71 and the second pinching plate 72.

Concerning the means for inserting the chaining thread moved to the operator side of the needle drop point into the insertion hole, in the above embodiment, the one to insert the chaining thread into the insertion hole by blowing out the air from the upper side of the insertion hole is employed, but it is also possible to install, instead of it, the means for inserting the chaining thread into the insertion hole by sucking the air from the lower side of the insertion hole, and further possible to use these means together.

It is possible, to design the blow pipe 15 described above, or the blow pipe equipped with the air blow-out port disposed on the cloth plate obliquely ahead of the suction hole and obliquely behind the insertion hole to move vertically so as to hide its air blow-out port beneath the working face when unnecessary. Furthermore, if the air blow-out port is formed laterally wide as shown in the drawing, it is possible to blow out the air in a widely diffused state along the working face, and thereby the chaining thread moved to the front of the air blow-out port can be blown away securely even if a certain extent of deflection is present in the position of the chaining thread in each time. As the air blow-out port, however, a round blow-out port like an ordinary nozzle or a multiple number of round nozzles in a short diameter arranged vertically may also be used. But in this case, it is necessary to arrange the air blow-out port itself so as face to the chaining thread pinching side.

What is claimed is:

1. A chaining thread sew-in device of an overlock sewing machine having a working face, a needle drop point and a suction device located at a rear side of the needle drop point and defining a suction hole, the overlock sewing machine being designed: to suck a chaining thread formed consecutively with the seams produced at an edge of a cloth on which the overlock sewing machine operates into the suction hole of the suction device; to cut the chaining thread in the suction hole; to move a free end of the chaining thread left on the sewing machine side to the operator side of the needle drop point by air pressure; and to sew the chaining thread moved in this way into the seams formed on the next cloth operated on by the overlock sewing machine, said chaining thread sew-in device comprising:

a first pinching plate forming part of the working face of the sewing machine on the operator side of the needle drop point and mounted to be moved so as to open an insertion hole in which the free end of the chaining thread moved from the suction hole can be inserted on the working face;

chaining thread insertion means for inserting the free end of the chaining thread into the insertion hole by the application of air pressure;

a second pinching plate which contacts the first pinching plate when the insertion hole is not opened and forms a part of the edge of the insertion hole when the insertion hole is opened, said second pinching plate mounted to be moved in a direction approaching the first pinching plate when the insertion hole is opened, and the free end of the chaining thread toward the first pinching plate accompanies the movement of the second pinching plate during its movement toward the first pinching plate; and a cutter including a fixed knife portion and a movable knife portion, said cutter being mounted so as to cross said fixed knife portion with said movable knife portion in a moving region of the chaining thread caused by the movement of the second pinching plate toward the first pinching plate.

2. A chaining thread sew-in device of an overlock sewing machine as set forth in claim 1, wherein the overlock sewing machine further has a blow pipe connected to the suction device, said blow pipe defining an air blow-out port located adjacent the working face obliquely ahead of the suction hole and obliquely behind the insertion hole, wherein:

the free end of the chaining thread may be moved from the suction hole to the operator side of the needle drop point during blowing out of the free end of the chaining thread from the suction hole by the air supplied through the blow pipe, and to the insertion hole side by the air blown out from the air blow-out port.

3. A chaining thread sew-in device of an overlock sewing machine as set forth in claim 1, wherein the first pinching plate and the second pinching plate move linearly in the direction crossing the sewing axis of the sewing machine.

4. A chaining thread sew-in device of an overlock sewing machine as set forth in claim 3, wherein the overlock sewing machine further has a throat plate on which a tongue is integrally formed, said tongue being situated opposite a side face of the throat plate forming a slit starting from the needle drop point and extending backward, and defining a stepped part for engaging a base end part of the chaining thread on its side which is opposite the side face of the throat plate, and wherein said seams are formed by turning the threads on the tongue.

5. A chaining thread sew-in device of an overlock sewing machine as set forth in claim 4, wherein the chaining thread insertion means is designed to insert the free end of the chaining thread into the insertion hole by blowing out air toward an upper side of the working face of the sewing machine to said insertion hole.

6. A chaining thread sew-in device of an overlock sewing machine as set forth in claim 4, wherein the chaining thread insertion means is designed to insert the free end of the chaining thread into the insertion hole by sucking air from a lower side of the working face of the sewing machine.

7. A chaining thread sew-in device of an overlock sewing machine as set forth in claim 2, wherein the first pinching plate and the second pinching plate move linearly in the direction crossing the sewing axis of the sewing machine.

8. A chaining thread sew-in device of an overlock sewing machine as set forth in claim 2, wherein the first pinching plate and the second pinching plate each have a rotation axis about which they rotate.

9. A chaining thread sew-in device of an overlock sewing machine as set forth in claim 8, where in the overlock sewing machine further has a throat plate on which a tongue is integrally formed, said tongue being situated opposite a side face of the throat plate forming a slit starting from the needle drop point and extending backward, and defining a stepped part for engaging a base end part of the chaining thread on its side which is opposite the side face of the throat plate, and wherein said seams are formed by turning the threads on the tongue.

10. A chaining thread sew-in device of an overlock sewing machine as set forth in claim 9, wherein the chaining thread insertion means is designed to insert the free end of the chaining thread into the insertin hole by blowing out air toward an upper side of the working face of the sewing machine to said insertion hole.

11. A chaining thread sew-in device of an overlock sewing machine as set forth in claim 9, wherein the chaining thread insertion means is designed to insert the free end of the chaining thread into the insertion hole by sucking air from a lower side of the working face of the sewing machine.

12. A chaining thread sew-in device of an overlock sewing machine as set forth in claim 7, wherein the overlock sewing machine further has a throat plate on which a tongue is integrally formed, said tongue being situated opposite a side face of the throat plate forming a slit starting from the needle drop point and extending backward, and defining a stepped part for engaging a base end part of the chaining thread on its side which is opposite the side face of the throat plate, and wherein said seams are formed by turning the threads on the tongue.

13. A chaining thread sew-in device of an overlock sewing machine as set forth in claim 12, wherein the chaining thread insertion means is designed to insert the free end of the chaining thread into the insertion hole by blowing out air toward an upper side of the working face of the sewing machine to said insertion hole.

14. A chaining thread sew-in device of an overlock sewing machine as set forth in claim 12, wherein the chaining thread insertion means is designed to insert the free end of the chaining thread into the insertion hole by sucking air from a lower side of the working face of the sewing machine.

15. A chaining thread sew-in device of an overlock sewing machine as set forth in claim 1, wherein the first pinching plate and the second pinching plate each have a rotation axis about which they rotate.

16. A chaining thread sew-in device of an overlock sewing machine as set forth in claim 15, wherein the overlock sewing machine further has a throat plate on which a tongue is integrally formed, said tongue being situated opposite a side face of the throat plate forming a slit starting from the needle drop point and extending backward, and defining a stepped part for engaging a base end part of the chaining thread on its side which is opposite the side face of the throat plate, and wherein said seams are formed by turning the threads on the tongue.

17. A chaining thread sew-in device of an overlock sewing machine as set forth in claim 16, wherein the chaining thread insertion means is designed to insert the free end of the chaining thread into the insertion hole by sucking air from a lower side of the working face of the sewing machine.

18. A chaining thread sew-in device of an overlock sewing machine as set forth in claim 16, wherein the chaining thread insertion means is designed to insert the free end of the chaining thread into the insertion hole by blowing out air toward an upper side of the working face of the sewing machine to said insertion hole.

* * * * *